US009029671B1

(12) United States Patent
Smith

(10) Patent No.: US 9,029,671 B1
(45) Date of Patent: May 12, 2015

(54) TREMOLO LOCK

(71) Applicant: Michael Eugene Smith, Ooltewah, TN (US)

(72) Inventor: Michael Eugene Smith, Ooltewah, TN (US)

( * ) Notice: Subject to any disclaimer, the term of this patent is extended or adjusted under 35 U.S.C. 154(b) by 0 days.

(21) Appl. No.: 13/999,977

(22) Filed: Apr. 11, 2014

(51) Int. Cl.
*G10D 3/14* (2006.01)
*G10D 1/08* (2006.01)

(52) U.S. Cl.
CPC ..... *G10D 3/146* (2013.01); *G10D 1/085* (2013.01)

(58) Field of Classification Search
CPC ..... G10D 3/146
See application file for complete search history.

(56) References Cited

U.S. PATENT DOCUMENTS 4,643,070 A * 2/1987 Petrillo ..... 84/313
4,697,493 A * 10/1987 Ralston ..... 84/313
4,763,555 A * 8/1988 Minakuchi et al. ..... 84/313
4,882,967 A * 11/1989 Rose ..... 84/313
4,892,025 A * 1/1990 Steinberger ..... 84/313
5,311,804 A * 5/1994 Wilkinson ..... 84/313
5,986,192 A * 11/1999 Wingfield et al. ..... 84/313
6,765,137 B2 * 7/2004 Smart ..... 84/313
6,812,389 B2 * 11/2004 Trooien ..... 84/313
6,919,501 B2 * 7/2005 Burton ..... 84/313
7,145,065 B2 * 12/2006 Geier ..... 84/313
7,427,703 B2 * 9/2008 Geier ..... 84/313
8,207,433 B1 * 6/2012 Maiorana ..... 84/313
2006/0005687 A1 * 1/2006 Minakuchi ..... 84/313
2014/0165817 A1 * 6/2014 Cadwell et al. ..... 84/313

* cited by examiner

*Primary Examiner* — Robert W Horn

(57) ABSTRACT

A tremolo lock as provided preferably to allow the operator to engage the lock or stop from the topside of a guitar and tremolo base plate completing a floating double locking tremolo system preferably for electric guitars. Many embodiments also provide calibration adjustments, mounted within the cavity of guitar body, so the operator can make adjustments while the tremolo is floating, to the preset pitch tuning level position of the tremolo system such as, after a string breaks to return the remaining stings back in tune. Calibration adjustments for tuning can also be made when in the lock or stop position therefore altering and adjusting the preset pitch tuning. Many embodiments of the present invention provide the ability to easily disengage the lock or stop and return the tremolo system back to a floating position.

14 Claims, 12 Drawing Sheets

TREMOLO LOCK

CROSS-REFERENCE TO RELATED APPLICATION

The present invention is a continuation of U.S. Provisional Patent Application Ser. No. 61/811,431 of Michael E. SMITH, entitled "TREMOLO LOCK", filed on Apr. 12, 2013 the entire disclosures of all of which are here by incorporated by reference herein.

FIELD OF THE INVENTION

The present invention relates to tremolo locks and stops for use with musical stringed instruments, particularly electric guitars having a floating double locking tremolo system with a tremolo arm used to move in an up and down motion of the tremolo, changing tension of strings creating a recognizable vibrato effect, with this invention used to stop motion of a tremolo in at least one and/or both up and down directions from a topside of the tremolo base plate string side and of a guitar and for many embodiments to provide a calibration adjustment for aligning with the elevation level of the tremolo base plate for lock and/or stop position.

BACKGROUND OF THE INVENTION

Floyd Rose® developed a floating double locking tremolo system in the mid 1980's and late 1970's which became widely accepted. Many companies sell tremolo systems also referred to, as vibrato systems which date back to the 1950's. The tremolo system in U.S. Pat. No. 4,477,236 to Rose, 1985 Feb. 5 and a locking nut U.S. Pat. No. 4,171,661 to Rose, 1979 Oct. 23 having two two points for locking the strings. The first is in the saddles supported by the tremolo base plate and second at the nut. This will minimize the strings from going out of tune caused by the binding of strings in the nut and tremolo system when using the tremolo by those skilled in the art Springs are connected to the back of a guitar body and a block mounted to the bottom side of a tremolo base plate. The springs counteract the tension of guitar strings. The elevation level of a tremolo system base plate is adjusted, so it does not rest on a guitar body and pivoting allowing movement up and down, this is known as floating creating a recognizable vibrato effect.

A tremolo system when in the floating position and a string breaks, necessarily reduces the tension of the rest of the strings by the spring tension at the back of a guitar altering the elevation level of a tremolo base plate, thereby pulling all of the remaining strings out of tune. This is a disadvantage rendering a guitar basically unplayable. In order to overcome this disadvantage, many guitar players utilize a block of wood or other tremolo lock and stop mechanisms, particularly those located at the back of a guitar to temporarily or permanently fix the position of a tremolo. Their location is difficult to access and operate, often preventing a floating tremolo system from operating as designed and unable to return the strings back to the preset pitch tuning when a string breaks while a tremolo system is floating.

SUMMARY OF THE INVENTION

In the presently preferred embodiment of the invention, a tremolo lock having a catch guide with a slot and hole topside with corresponding hole bottom side and mounting holes bottom side. Two mounting bolts having a threaded shaft, pass through mounting holes rotating into corresponding threaded holes bottom side of a tremolo base plate, therefore mounted. A catch guide having open ends houses a fork. The fork having a hex shaft that extends through a slot. A handle having a hex shaft is mounted in the hex shaft of the fork. A bolt with a threaded shaft passes through a hex shaft of the handle. The bolt rotated into a threaded hole in a fork securing the handle to the fork. A fork handle one-piece combination is optional.

The slot catches the shaft preventing movement of fork beyond the engage lock position or stop position and floating position. A lock down bolt having a threaded shaft and a hex insert and a ledge for securing topside of the fork and passes through the hole topside of the catch guide, through an open area of the fork and rotated (clockwise) into the corresponding threaded hole on the tremolo base plate and passing through the corresponding hole bottom side of the catch guide.

The lock down bolt is loosened (counterclockwise) for movement of the fork when transitioning to the lock or stop and floating position. The handle slides the fork across the topside plain of the tremolo base plate and protrudes out an open end of the catch guide. The fork engages with a notch on a calibration bolt for the lock position (no movement) of the tremolo, or engages the topside of the calibration bolt for the stop position (movement in one direction) of the tremolo. The lock down bolt is tightened securing the fork, therefore completing the lock or stop position.

The calibration bolt having a hex insert and a threaded shaft rotates into a threaded bore of a block or a optional cylinder, with mounting holes for mounting with screws within the body of a guitar. A hex wrench adjusts the calibration bolt. Rotation of the calibration bolt up (counter clockwise) and down (clockwise) for calibrating the bolt to the preset pitch tuning height level of the tremolo base plate.

The lock down bolt is tightened (clockwise) with a hex wrench and/or an optional handle therefore securing the fork after the engagement of the lock or stop and floating position. The lock down bolt is loosened (counter clockwise) for transitioning to the lock or stop and floating position, tremolo pivoting having movement in both up and down directions.

Advantages

It is an advantage for one or more aspects of the present invention to provide a new tremolo lock that can easily be operated by those of ordinary skill in the art, Another advantage for one or more aspects of the present invention is, when a floating double is floating and a string breaks, the operator engages the lock or stop position and secures the fork with the lock down bolt, the strings will return back to the preset pitch tuning, Another advantage for one or more aspects of the present invention is, the calibration bolt having multiple purposes. In the disengaged floating position, the ability to calibrate the elevation level of the calibration bolt, to the preset elevation level of the tremolo base plate.

Another advantage for one or more aspects of the present invention is, the ability to adjust the elevation level of the tremolo base plate when in the lock or stop position therefore adjusting the tuning.

Another advantage for one or more aspects of the present invention is, the lock down bolt securing the fork prevents rattling, Another advantage for one or more aspects of the present invention is, having two separate operational modes, Mode A) lock position (no movement) of the tremolo and floating position (movement in both directions) of a tremolo or Mode B) stop position (movement in one direction) of the tremolo and floating position (movement in both directions) of the tremolo.

Additionally, another advantage for one or more aspects of the present invention is, no mounting to painted surface devaluing the guitar and having an attractive integrated structure.

BRIEF DESCRIPTION OF THE DRAWINGS

The particular features and advantages of the invention as well as many preferred embodiments will become apparent from the following description taken in connection with the accompanying drawings in which.

DETAILED DESCRIPTION OF THE PREFERRED EMBODIMENTS

Figure 1:
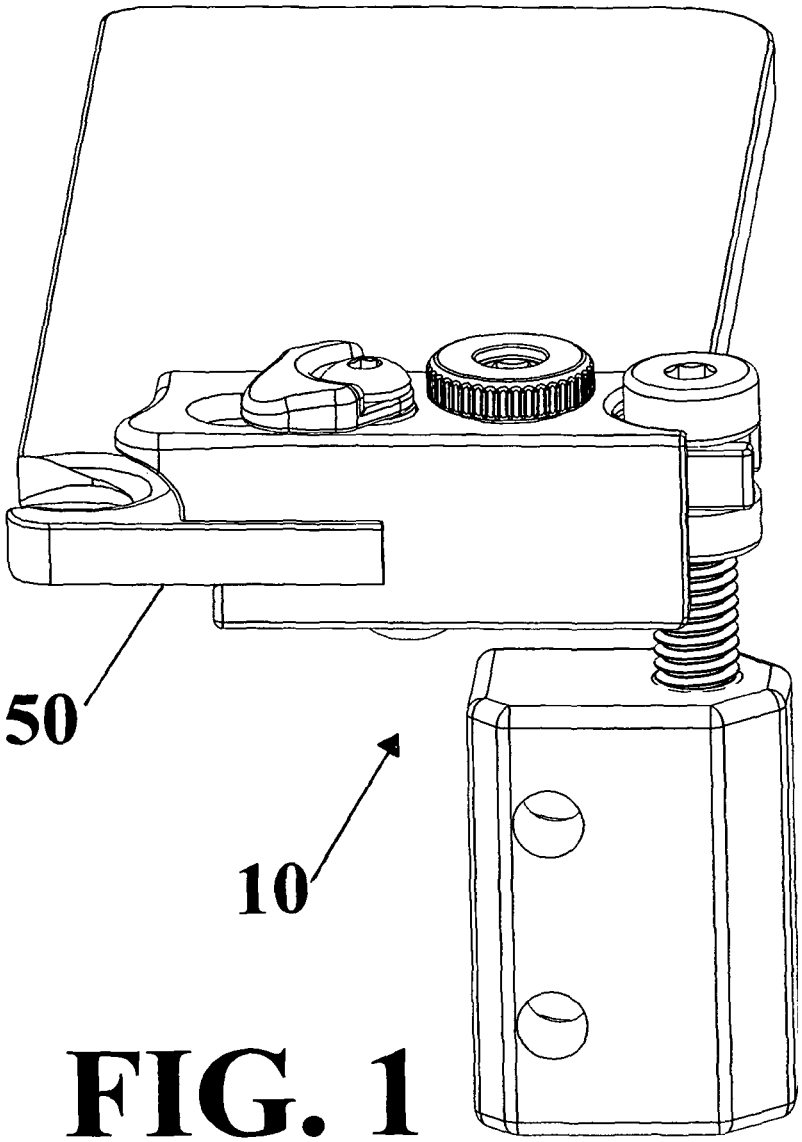
FIG. 1 is an enlarged perspective view of a tremolo lock mounting location on a tremolo base plate.
Figure 6:
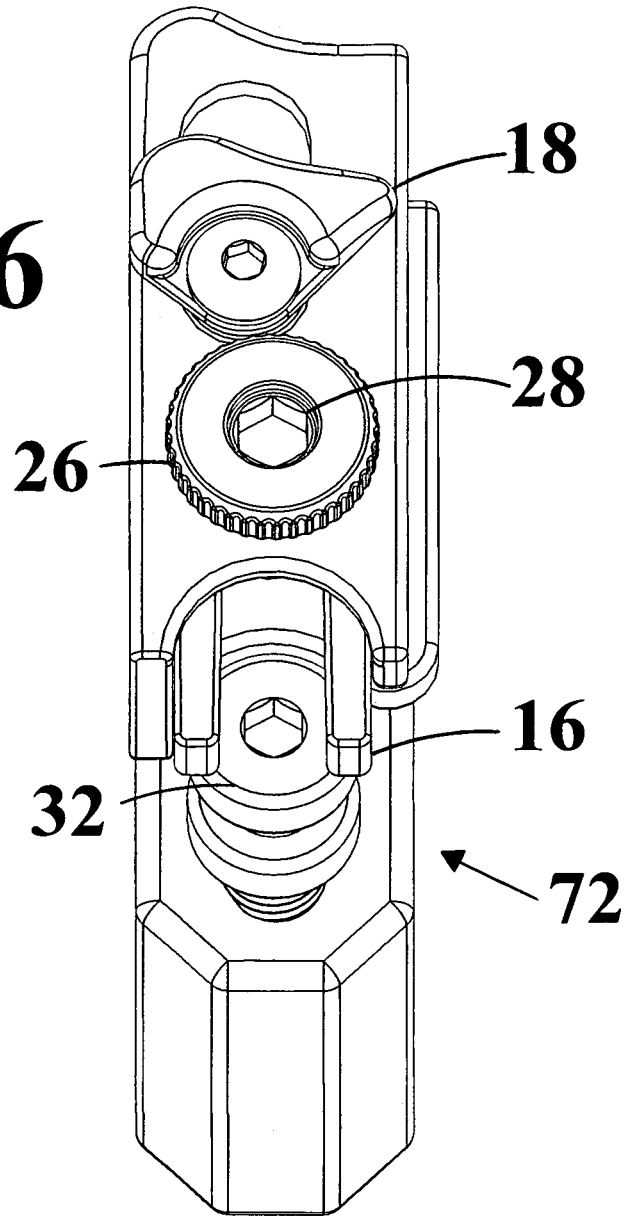
FIG. 6 is an enlarged perspective view of a tremolo lock in a stop position.
Figure 10:
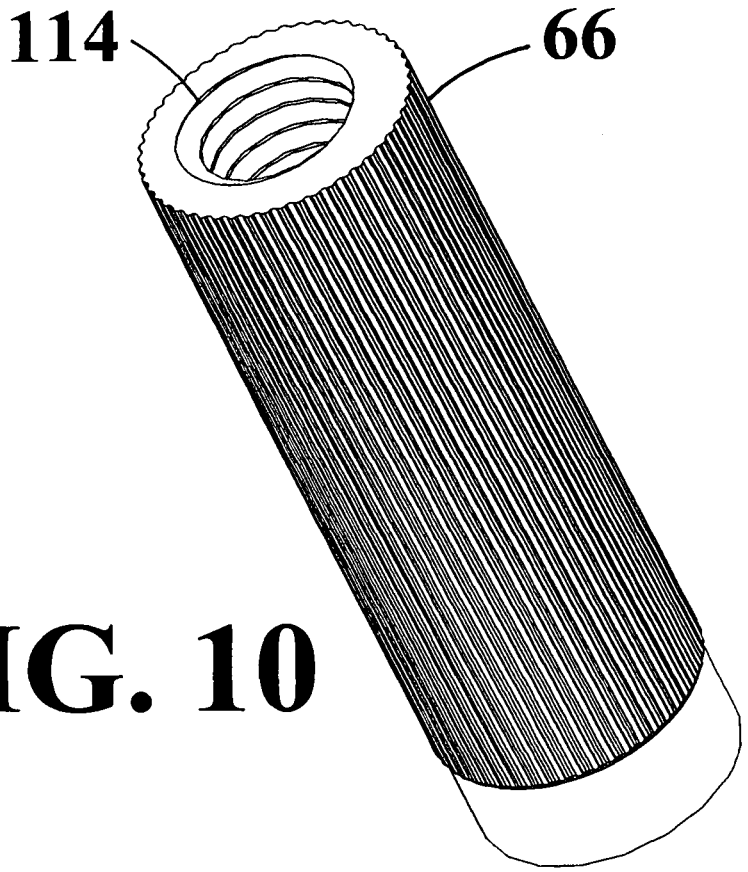
FIG. 10 is an enlarged perspective view of an optional cylinder.

The embodiments of the present invention are illustrated by way of example and not by way of limitation in the figures of the accompanying drawings and in which like reference numerals refer to similar elements and in which, In the presently preferred embodiment of the present invention, which comprises a tremolo lock 10 (FIG. 1) preferably made of metal shows mounted location on a tremolo base plate 50 (FIG. 1) the presently preferred embodiments, a block 36 (FIG. 2,3) or a cylinder 66 (FIG. 10) with a calibration bolt 32 (FIG. 2,3) is mounted within the body of a guitar (not shown) having a fork 16 (FIG. 2) housed inside a catch guide 12 (FIG. 2) protrudes out the opening 92 (FIG. 3) that engages into a notch 30 (FIG. 2,3) on the calibration bolt 32 (FIG. 2) for the lock 22 (FIG. 2) position, eliminating movement up or down of the tremolo. The stop 72 (FIG. 6) position the fork engages the top of the calibration bolt 32 (FIG. 6) allowing movement in only one direction of the tremolo requires the calibration bolt 32 (FIG. 6) lowered so that the fork 16 (FIG. 6) engages the top of the calibration bolt 32 (FIG. 6) as would be understood by those of skill in the art.

Figure 3:
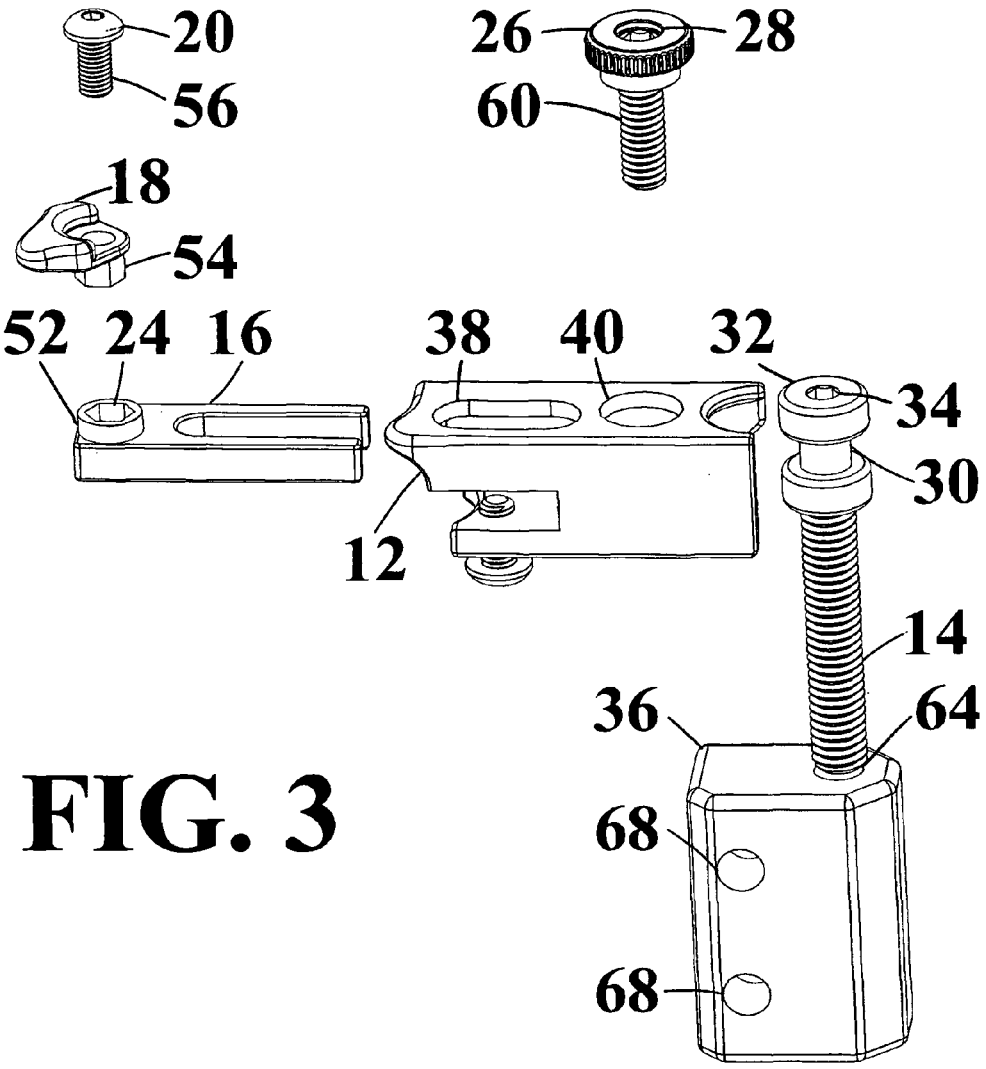
FIG. 3 is an enlarged perspective view of a tremolo lock of components.
Figure 4:
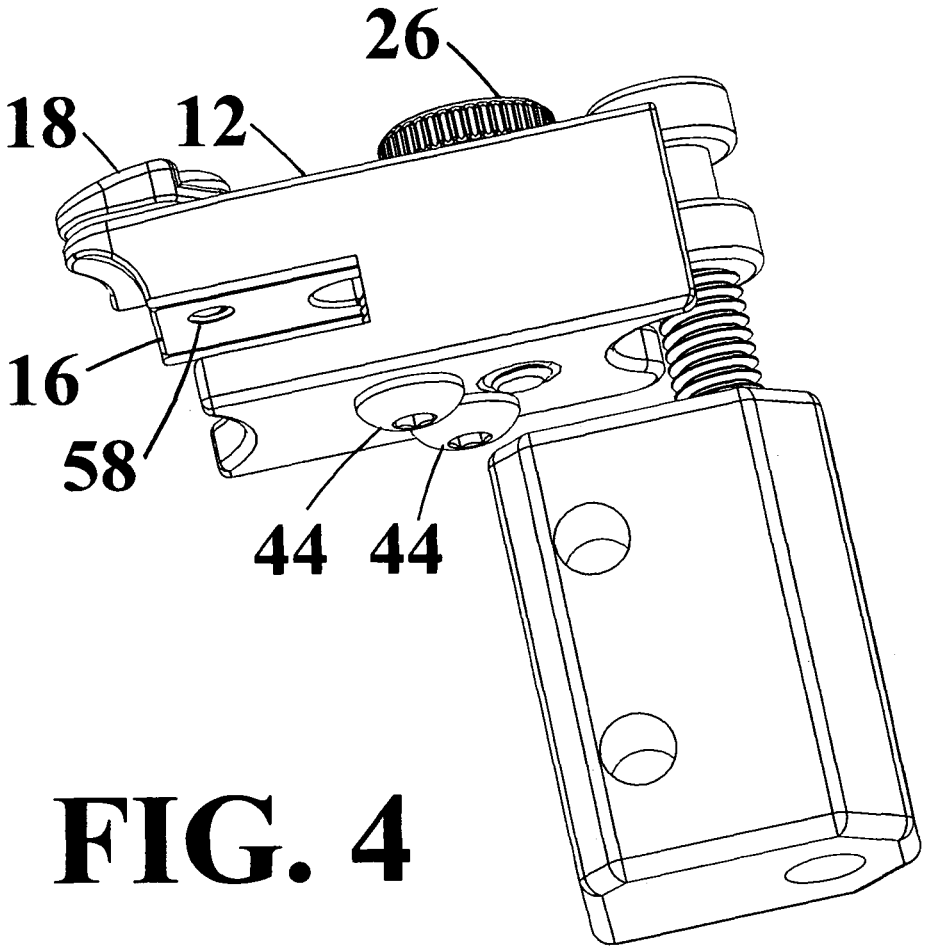
FIG. 4 is an enlarged perspective bottom view of a tremolo lock of components.

In the presently preferred embodiments the present invention having a catch guide 12 (FIG. 2,4,9) housing a fork 16 (FIG. 2,4) with a shaft 52 (FIG. 3) that protrudes into a slot 38 (FIG. 3) having a hex insert 24 (FIG. 3), a handle 18 (FIG. 3) with a hex shaft 54 (FIG. 3) inserts into the hex insert 24 (FIG. 3) connecting the fork 16 (FIG. 3) to the handle 18 (FIG. 3) and bolt 20 (FIG. 2,3) having a threaded shaft 56 (FIG. 3) passes through the hex shaft 54 (FIG. 3) and rotates (clockwise) into a threaded hole 58 (FIG. 4)) in the fork 16 (FIG. 4) securing the handle 18 (FIG. 4). The operator as known by those of skill in the art moves the handle 18 (FIG. 2) which moves the fork 16 (FIG. 2) inside the slot 38 (FIG. 3) catches the shaft 52 (FIG. 3) preventing movement beyond the engaged lock 22 (FIG. 2) position or stop 72 (FIG. 6) position.

Figure 5:
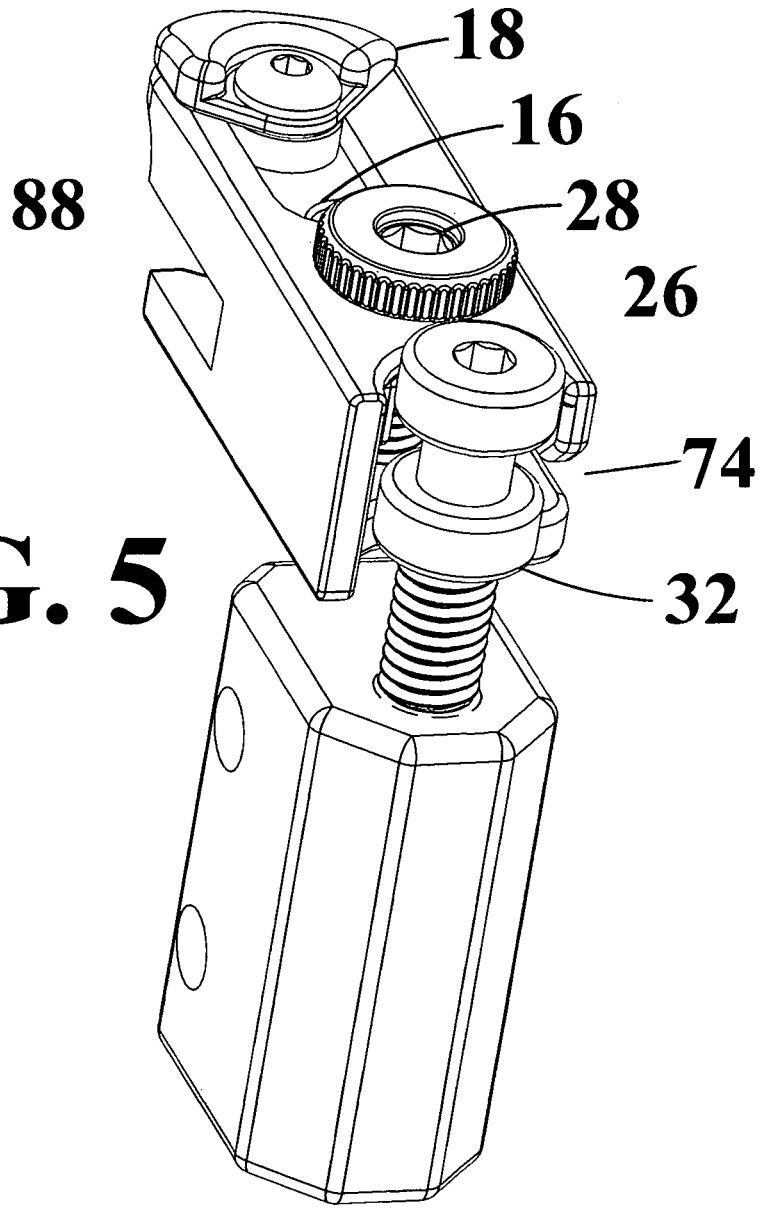
FIG. 5 is an enlarged perspective view of a tremolo lock in a floating position.
Figure 8:
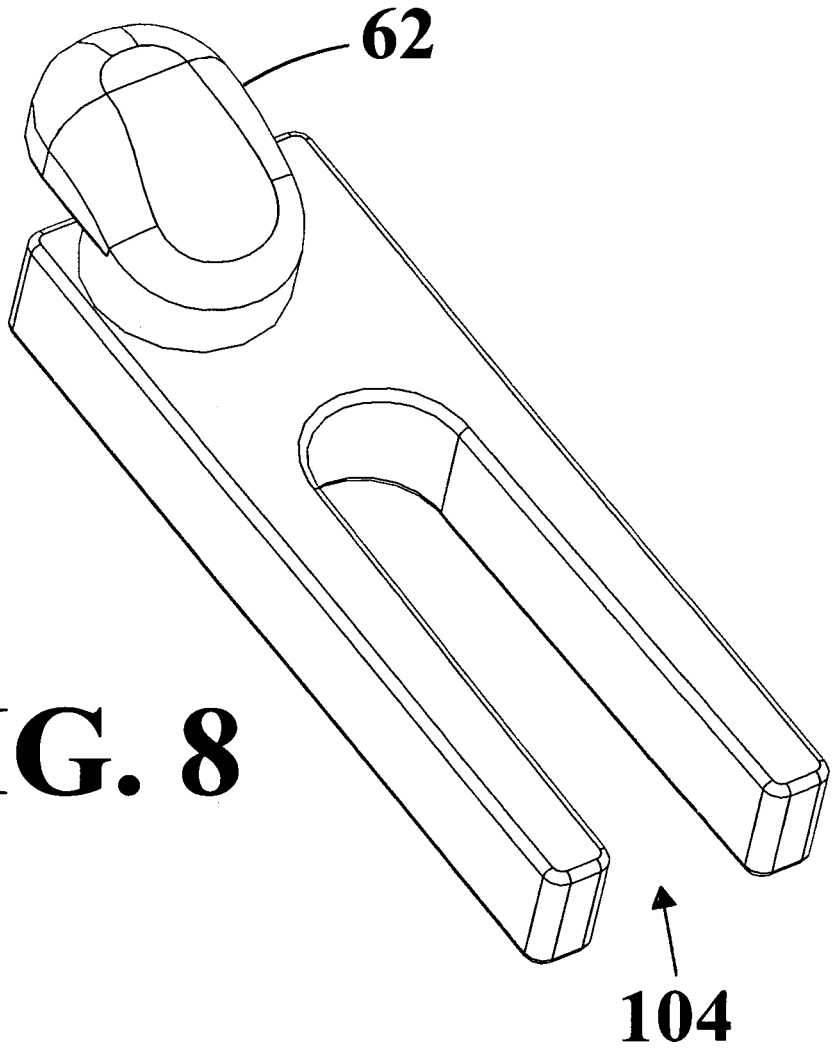
FIG. 8 is an enlarged perspective view of an optional fork handle.
Figure 9:
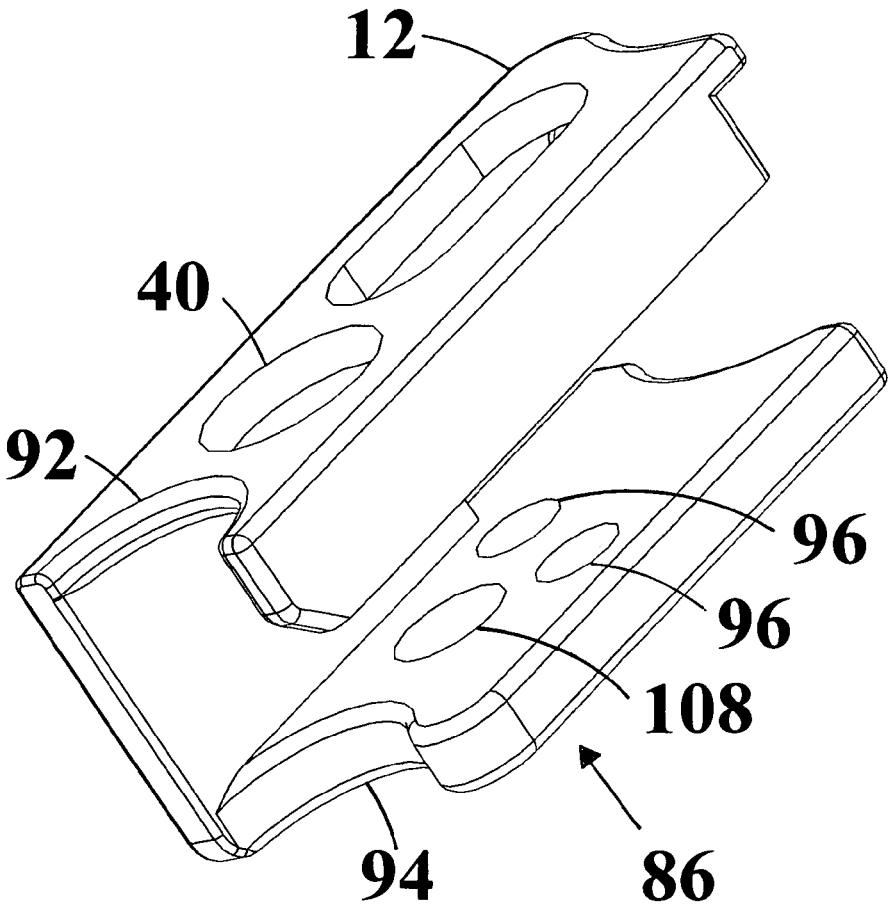
FIG. 9 is an enlarged perspective view of a catch guide showing holes and cut outs.
Figure 11:
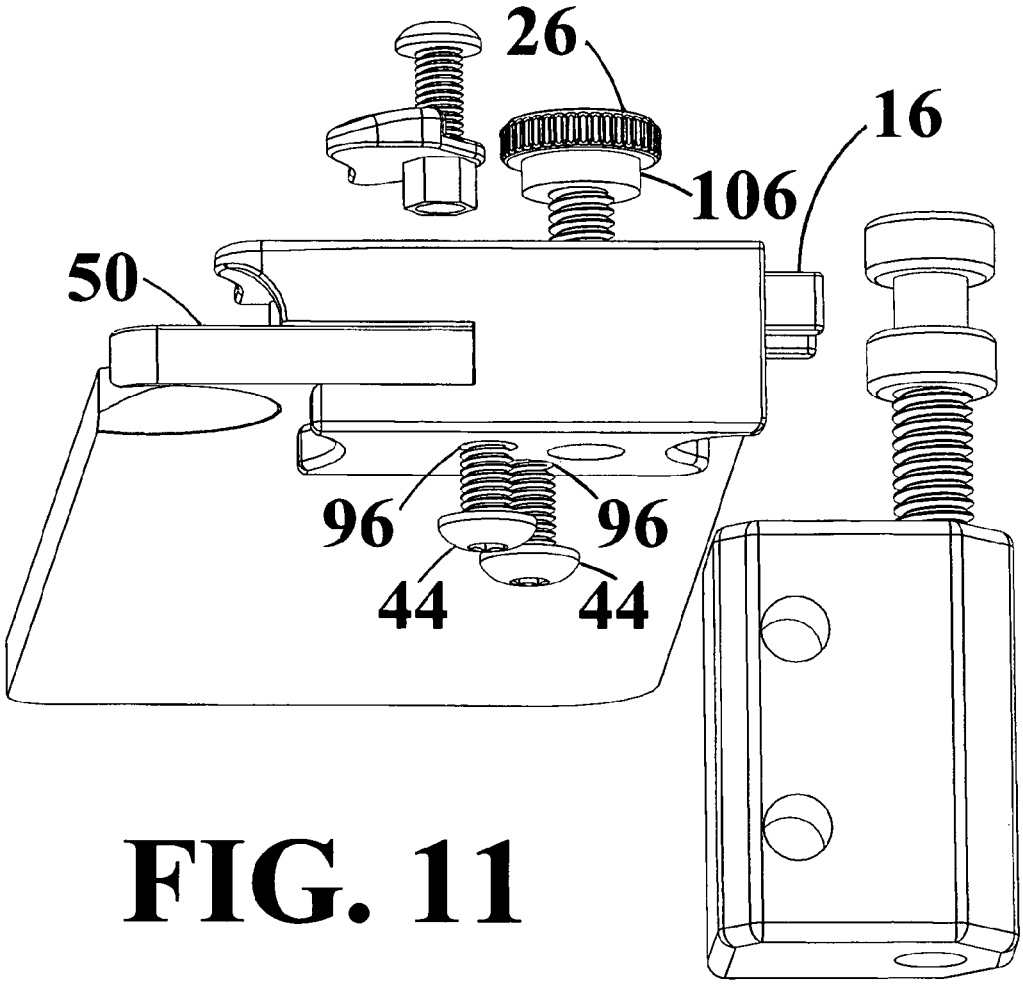
FIG. 11 is an enlarged perspective view of mounting bolts and mounting location.
Figure 12:
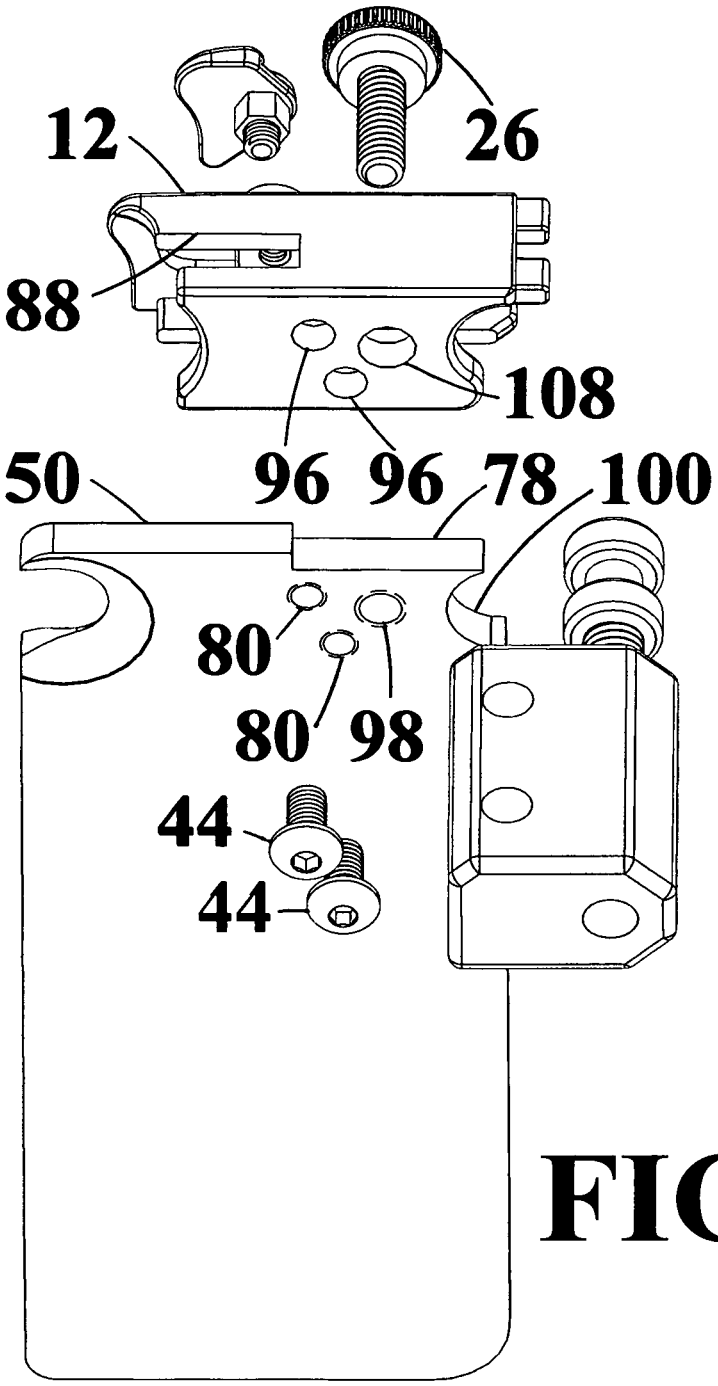
FIG. 12 is an enlarged bottom view of coordinating holes, threaded holes and cut out configurations for a catch guide and tremolo base plate.

The catch guide 12 (FIG. 9) having an opening 86 (FIG. 9) on one side, an open end rectangular cut out 88 (FIG. 5) in the sidewall, a half moon cut out 92 (FIG. 9) on the topside and a half moon cut out 94 (FIG. 9) on the bottom side. The tremolo base plate 50 (FIG. 12) having the corresponding cut outs, cut out 78 (FIG. 12) for cut out 88 (FIG. 5) cut out 100 (FIG. 12) for cut out 92 (FIG. 9) and 94 (FIG. 9). The bottom side of the catch guide 12 (FIG. 4,12) having two mounting holes 96 (FIG. 12) and two mounting bolts 44 (FIG. 4,12) for mounting the catch guide 12 (FIG. 12) into to threaded mounting holes 80 (FIG. 9,12) on the tremolo base plate 50 (FIG. 12). A lock down bolt 26 (FIG. 2,3) having a threaded shaft 60 (FIG. 3.12) passes through a hole 40 (FIG. 3) on the topside of guide casing 12 (FIG. 3) through the opening 104 (FIG. 8) on the fork with the bottom side of ledge 106 (FIG. 11) not going past the topside of the fork 16 (FIG. 11) is rotated into a threaded hole 98 (FIG. 12) passing through a hole 108 (FIG. 12) on the bottom side of the catch guide 12 (FIG. 12). The presently preferred embodiments of the present invention and inclusive herein, the catch guide and tremolo base plate having coordinating cut outs, holes and threaded holes.

Figure 7:
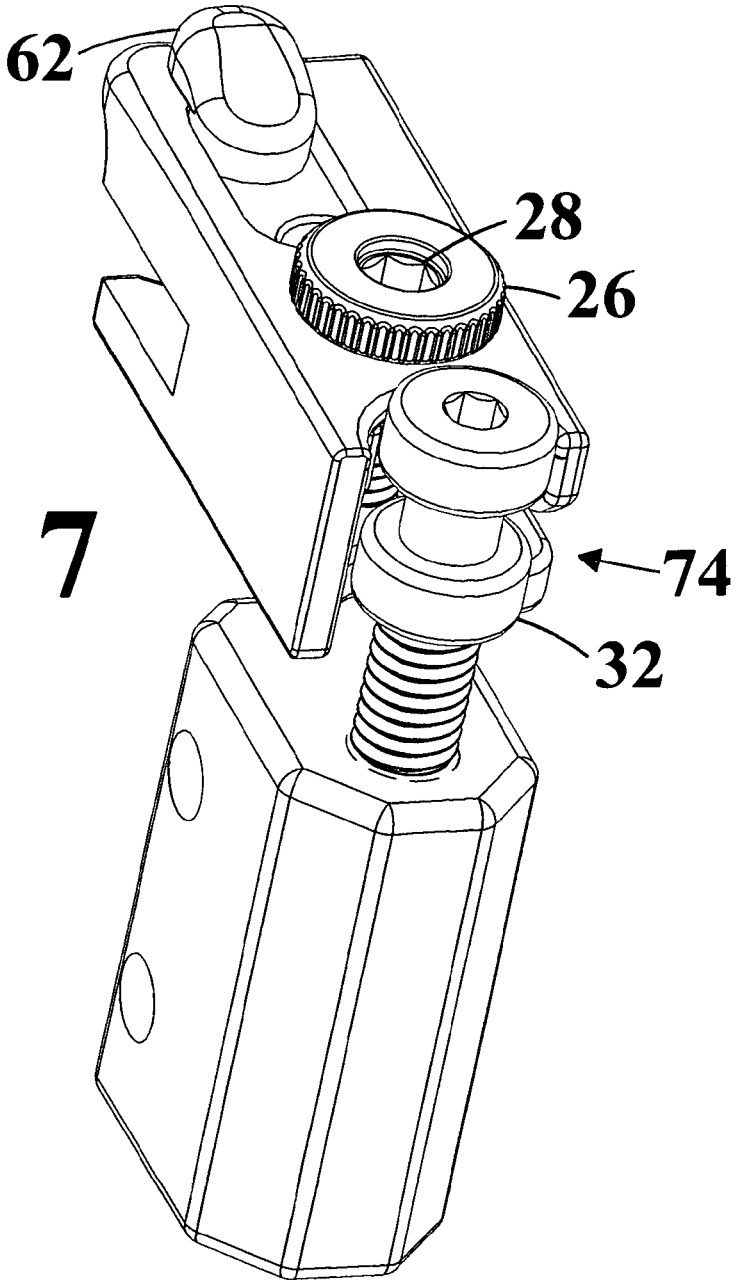
FIG. 7 is an enlarged perspective view of a tremolo lock with an optional fork handle

The fork 16 (FIG. 2) housed inside the catch guide 12 (FIG. 2) secured to the handle 18 (FIG. 2) topside of catch guide. The operator as known by those of skill in the art loosens (counter clockwise) the lock down bolt 26 (FIG. 2) and slides the fork 16 (FIG. 2) across the topside of the tremolo base plate 50 (FIG. 11) entering a notch 30 (FIG. 2) on the calibration bolt 32 (FIG. 2) engaging the lock 22 (FIG. 2) position. The operator adjusts the calibration bolt 32 (FIG. 6) down (clockwise) so that the bottom side of the fork 16 (FIG. 6) engages the topside of the calibration bolt 32 (FIG. 6) engaging the stop 72 (FIG. 6) position. The lock down bolt 26 (FIG. 2,3,6) having a hex 28 (FIG. 2,3,6) insert, is tightened down (clockwise) by the operator, with a hex wrench (not shown) and/or an optional handle (not shown) securing the fork 16 (FIG. 2,6) completing the lock 22 (FIG. 2) or stop 72 (FIG. 6) and floating 74 (FIG. 5,7) position. The lock down bolt 26 (FIG. 2,3,5,6) having a hex 28 (FIG. 2,3,5,6) insert is loosened (counter clockwise) with a hex wrench (not shown) and/or an optional handle therefore releasing the fork 16 (FIG. 5) and/or optional fork handle 62 (FIG. 7) mounted to the lock down bolt for transitioning from and/or to the lock 22 (FIG. 2) or stop 72 (FIG. 6) and floating 74 (FIG. 5,7) position.

The calibration bolt 32 (FIG. 2) having a threaded shaft 14 (FIG. 3) and a hex 34 (FIG. 3) insert the operator using a hex wrench (not shown) and rotates (clockwise) the calibration bolt 32 (FIG. 2,3,5,6) into a threaded bore 64 (FIG. 3) of a block 36 (FIG. 2,3) having mounting holes 68 (FIG. 2,4) and screws are used (not shown) for mounting within the guitar body or an optional cylinder 66 (FIG. 10) with a threaded bore 114 (FIG. 10) can be used for receiving the calibration bolt 32 (FIG. 2,3,5,6) and further attached to the cylinder, a mounting hole plate (not shown) for mounting with screws. The operator as known by those skilled in the art loosen (counter clockwise) the lock down bolt 26 (FIG. 2,6), releasing the fork 16

(FIG. 2,6) and moves the handle 18 (FIG. 5) or the optional fork handle 62 (FIG. 7,8), retracting into the catch guide for the floating 74 (FIG. 5,7) position. The floating 74 (FIG. 5,7) position with the fork 16 (FIG. 5) or the optional one-piece fork handle 68 (FIG. 5,7) no longer engaged with the calibration bolt 32 (FIG. 5,7) the operator tightens the lock down bolt 26 (FIG. 5,7) (clockwise) with a hex wrench (not shown) in the hex insert 28 (FIG. 5,7) and/or with an optional handle (not shown) securing the fork therefore completing the floating 74 (FIG. 5,7) position. The tremolo floating having movement pivoting in both directions, up and down.

Figure 2:
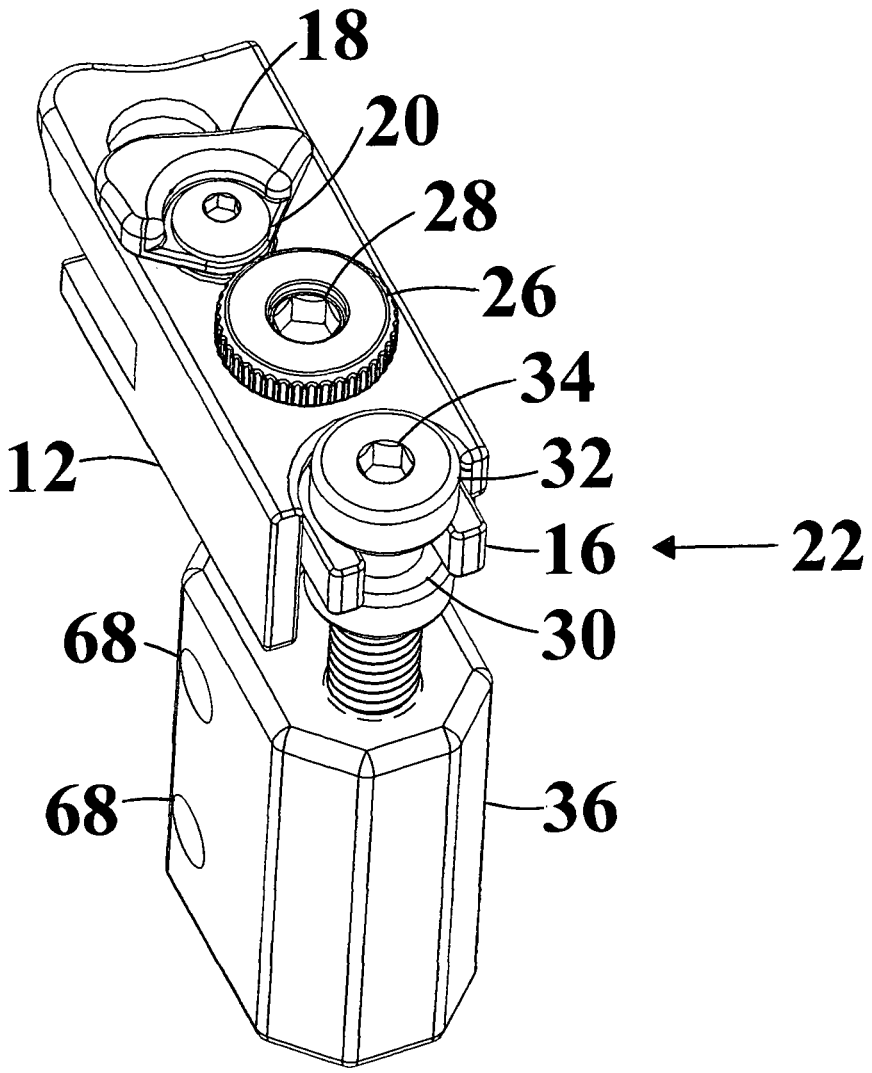
FIG. 2 is an enlarged perspective view of a tremolo lock in the lock position.

The calibration bolt 32 (FIG. 5,7) in the floating position 74 (FIG. 5,7) can be adjusted up or down by the operator as known by those of skill in the art calibrating the height of the bolt to the tremolo base plate leveled position that was preset by the preset pitch tuning. This assures the return to the previous preset tuning when a string breaks, when engaging the lock 22 (FIG. 2) or the stop 72 (FIG. 6) position and completing the position, securing the fork 16 (FIG. 2,6) with the lock down bolt 26 (FIG. 2,6). The operator can make tuning adjustments with the calibration bolt 32 (FIG. 2,6) while in the lock 22 or stop 72 positions.

What is claimed is:

1. A tremolo lock for a full floating tremolo to fully lock, to partially stop and to fully release the tremolo mechanism, comprising a catch guide comprising a channel for a sliding part, an elongate opening for a sliding part handle on the top of the catch guide, a bolt hole for a sliding part lock bolt and mounting holes, and bolts, a tremolo base plate having corresponding threaded mounting holes, threaded hole for lock bolt, and structure for mounting the catch guide to the tremolo plate, where the sliding part is a two-tined fork for sliding within the channel and includes a shaft that extends through the elongate opening of the catch guide for the sliding part handle, where the user moves the fork by the handle and thereby slides the fork out the open end of the catch guide to a stop formed by the edge of the elongate opening, the bolt through the catch guide and through the tines of the fork, into the threaded hole on the tremolo base plate, where a user locks the position of the fork by the tightening the lock bolt and so positioned the ends of the tines encircle a notch element arranged for holding the tremolo in the locked position, the notch element connected by a shaft to a immovable part of the instrument, where the user loosens the lock bolt and slides the fork back into the channel and tightens down the lock bolt to hold the fork in release position and to release the notch element.

2. The tremolo lock of claim 1, where the notch element and shaft onto which the fork is locked, further comprises that the shaft has threads, the threads which adjustably turn into a block or cylinder, solidly held to the instrument body.

3. The tremolo lock of claim 2, where the shaft has a bulbous head, including a hex key cavity, next come the notch and then an intermediate bulbous element and the shaft item, as a whole serves as a calibration bolt.

4. The tremolo lock of claim 3, where the calibration bolt is adjusted to a position that the fork tines engage the top of the bulbous head, to set the partially stopped position.

5. The tremolo lock of claim 1, where the handle is formed together with fork as a protruding item.

6. The tremolo lock of claim 1, where the handle comprises a bolt hole, a semicircular knob, a hex shape insert, and a bolt, and the fork comprises a handle mount portion in the form of a hex socket and a threaded hole, the handle hex insert mating with the fork hex socket and being attached together by the bolt, and where the user presses the knob and bolt head for moving the fork.

7. The tremolo lock of claim 1, where the catch guide attaches to a tremolo base plate bottom end edge, the catch guide comprising a cavity approximately matching the plate thickness of the tremolo plate, the bolts including one or more bolts holding the catch guide, the bolts extending upwardly through the bottom of the tremolo base plate, where the catch guide moves together with the tremolo plate in free floating mode and fully locks or partially stops the tremolo in the in tune position.

8. The tremolo lock of claim 2, where the cylinder is an item with internal threads and external splines, where the cylinder splines prevent rotation of the cylinder with the respect to the instrument body.

9. The tremolo lock of claim 2, where the block is mounted to the instrument body via side to side through holes with screws.

10. The tremolo lock of claim 1, where the lock bolt for securing the fork has a head with splines around the turning edge of the head for easy rotation by fingers and a hex socket for further tightening and loosening by Allen wrench.

11. The tremolo lock of claim 8, where the cylinder includes an attached plate with holes for mounting to the instrument with one or more screws into one or more pre-drilled holes in the plate and the instrument.

12. The tremolo lock of claim 1, where the lock bolt for securing the fork is a standard bolt with a hex head.

13. The tremolo lock of claim 12, where the lock bolt has a handle for easy loosening and tightening.

14. The tremolo lock of claim 3 or 4, where the calibration bolt comprises adjustment to the lock or stop positions of the tremolo base plate, to alternately a perfect tune position or to a higher or lower position than in tune.

* * * * *